US005135386A

United States Patent [19]

Kelley et al.

[11] Patent Number: 5,135,386

[45] Date of Patent: Aug. 4, 1992

[54] HYDROCARBON FLARE SYSTEM

[75] Inventors: Mark K. Kelley, Lake Jackson, Tex.; Max W. Thompson, Bartlesville, Okla.

[73] Assignee: Phillips Petroleum Company, Bartlesville, Okla.

[21] Appl. No.: 650,323

[22] Filed: Feb. 4, 1991

[51] Int. Cl.[5] ..... F23D 11/44

[52] U.S. Cl. ..... 431/11; 431/2; 431/208; 431/211; 431/5

[58] Field of Search ..... 431/11, 12, 2, 5, 6, 431/208, 211; 422/488–492

[56] References Cited

U.S. PATENT DOCUMENTS

| | | | |
|---|---|---|---|
| 4,140,473 | 2/1979 | Hoehing et al. | 431/11 |
| 4,148,599 | 4/1979 | Reed et al. | 431/11 |
| 4,241,722 | 12/1980 | Dickinson | 431/11 X |
| 4,289,475 | 9/1981 | Wall et al. | 431/11 |
| 4,302,177 | 11/1981 | Fankhanel et al. | 431/11 |
| 4,409,420 | 10/1983 | Van Pool et al. | 585/723 |

*Primary Examiner*—Larry Jones

*Attorney, Agent, or Firm*—Charles W. Stewart

[57] ABSTRACT

Method and apparatus are provided whereby a hydrocarbon gas and liquid mixture is separated into a first fluid and a second fluid. The first fluid is vaporized to form a vapor which is commingled with the second fluid. The commingled fluid is passed through a superheating exchange means wherein the commingled fluid is superheated prior to passing to a flare for combustion.

11 Claims, 1 Drawing Sheet

HYDROCARBON FLARE SYSTEM

BACKGROUND OF THE INVENTION

This invention relates to the handling of low temperature hydrocarbon fluid streams. In another aspect, this invention relates to method and apparatus for handling low temperature hydrocarbons in a flare gas relief system.

Safety relief systems are incorporated in essentially all chemical processing facilities. Included in these safety relief systems are pressure vessels provided with pressure relief valves to protect against over-pressure. Generally, the relief valves of these pressure vessels are connected into a common relief header whereby any relief fluids are passed downstream for further processing. In the case where the relief fluids are combustible, they are often passed to a flare system by which they are accumulated and combusted and whereby the combustion products are passed to the atmosphere.

A common problem that often occurs in cryogenic or low temperature processes is the release of low temperature fluid stream into a flare header system. For example, in an ethylene process, an ethylene liquid and gas mixture at its saturation temperature, which can be less than −103° F., is occasionally released into a flare header system that is maintained at a pressure of slightly above atmospheric pressure. Because of low saturation temperature of the ethylene, the piping within the flare system is subjected to extreme cold temperatures. Generally, the release of the ethylene to the flare system is on an intermittent basis and usually releases are done instantaneously or cyclic releases of cold fluids into the flare system can cause either thermal shock or thermal fatigue resulting in failure of the piping system caused by the stresses created from the extreme temperature changes.

Another problem encountered in cryogenic or low temperature processes is the relief of cold fluids into a flare header system that exit a flare stack and that are spewed into the atmosphere without combustion. The release of these cold fluids into the atmosphere has safety implications to personnel and to equipment.

SUMMARY OF THE INVENTION

It is, therefore, an object of this invention to improve the operation of a flare relief system.

Another object of this invention is to improve the safety of operation of a flare relief system.

A still further object of this invention is to provide protection of a flare relief system from either thermal shock or thermal fatigue created by rapid or cyclic changes in the temperature of the piping system.

In accordance with the present invention, method and apparatus are provided whereby a hydrocarbon gas and liquid mixture is separated into a first fluid and a second fluid. The first fluid is vaporized to form a vapor which is commingled with the second fluid. The commingled fluid is passed through a superheating exchange means wherein the commingled fluid is superheated prior to passing to a flare for combustion.

BRIEF DESCRIPTION OF THE DRAWING

Other aspects, objects and advantages of this invention will become apparent from a study of this disclosure, appended claims, and the drawing in which:

DESCRIPTION OF THE PREFERRED EMBODIMENT

Figure 1:
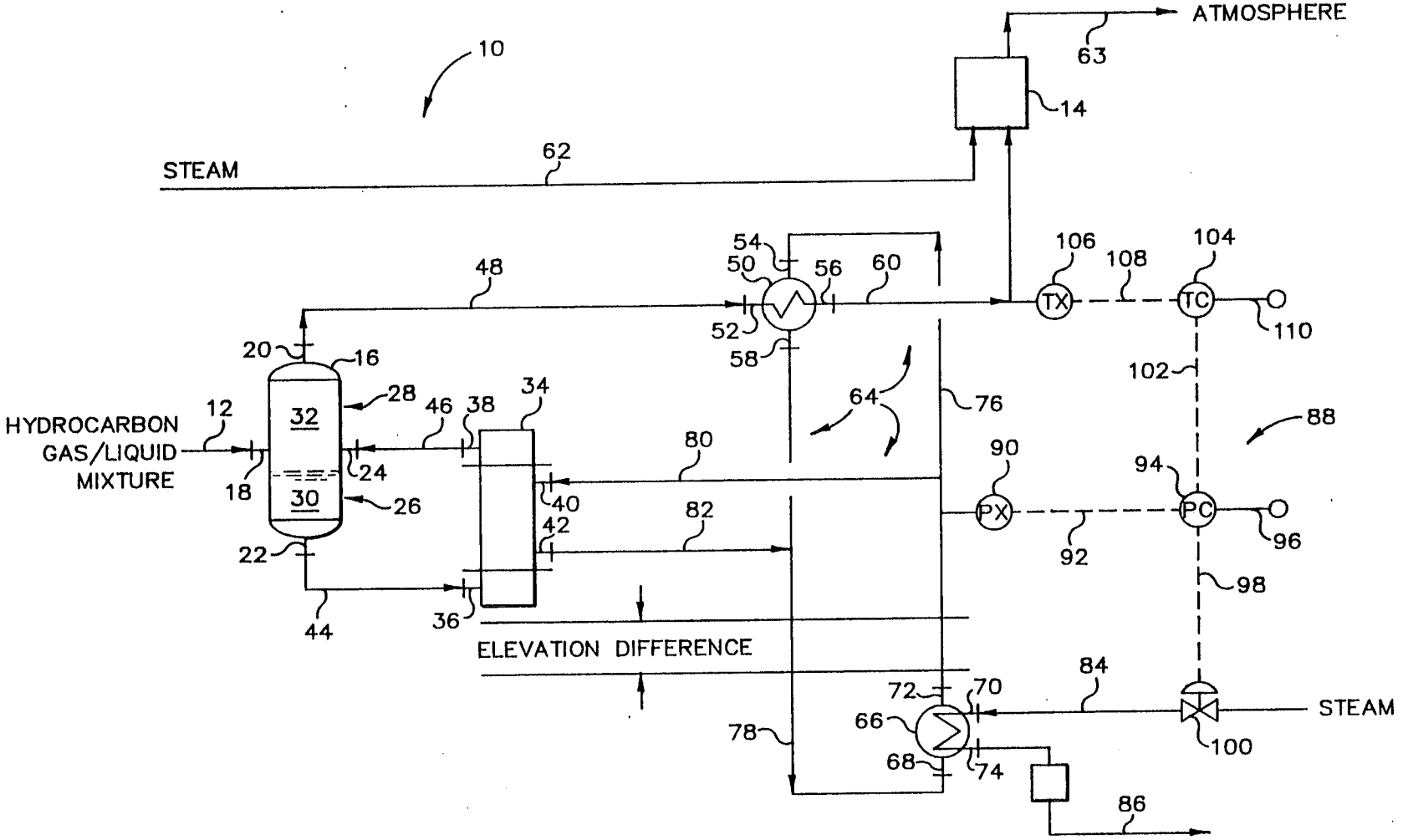
FIG. 1 is a schematic representation of the inventive flare gas handling process and the associated control system.

A specific control system configuration is set forth in FIG. 1 for the sake of illustration. However, the invention extends to different types of control system configurations which accomplish the purpose of the invention. Lines designated as signal lines in the drawing are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that, if a flow is measured in pneumatic form, it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent percentage or could be scaled to represent a temperature change required to make the desired and actual flows equal. If the controller output can range from 0 to 10 volts, which is typical, then the output signal could be scaled so that an output signal having a voltage level of 5.0 volts correspond to 50 percent, some specified flow rate, or some specified temperature.

The various transducing means used to measure parameters which characterize the process and the various signals generated thereby make take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a new flow measurement signal produce by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desire process value is therefore on from which the information regarding the measured or desired value can be readily retrieved regardless of the exact mathematical relationship between the signal units and the measured or desired process units.

Referring to FIG. 1, there is illustrated by schematic representation flare gas relief system 10. Charged to flare gas relief system 10 is a hydrocarbon feedstream that passes by way of conduit 12. The hydrocarbon feedstream charged to flare gas relief system 10 can be any hydrocarbon; but, for the effective use of the invention herein, the hydrocarbon of hydrocarbon feedstream is generally selected from those hydrocarbons of low molecular weight having generally three carbon atoms or less. The invention can be practiced with a hydrocarbon gas or a hydrocarbon liquid or some mixture thereof. Certain of the features of this invention are provided for handling such hydrocarbon gas and liquid mixtures at operating pressures of from about atmospheric to about 50 pounds per square inch absolute (psia). Because of the low operating pressure of flare relief system 10 and the thermodynamic properties of the hydrocarbon feedstream, the temperature of the hydrocarbon feedstream can be at such a low level to cause potential problems with failure of the piping or flare gas relief system 10 due to thermal shock, thermal fatigue, or both. As an example of the low temperatures encountered by flare gas relief system 10, the saturated temperature of the hydrocarbon compound ethylene at about atmospheric pressure is about −103° F. To solve the problems that often are encountered in ethylene processes in which ethylene is released into a flare header system, flare gas relief system 10 is provided. A gas and liquid mixture of ethylene at about atmospheric pressure is passed to flare gas relief system 10 which includes flare combustion device or burner 14. Burner 14 defines a combustion zone and provides means for mixing a combustible hydrocarbon with an oxygen-containing gas, such as air, and optionally, steam for atomization, and combusting or burning the combustible hydrocarbon. The presence of the liquids in the hydrocarbon feedstream not only pose problems with thermal stress of the piping due to the low temperature, but also, the presence of these liquids creates safety problems through their possible release into the atmosphere.

The hydrocarbon feedstream is introduced or charged via conduit 12 to phase separation vessel or separator 16, which has a feed inlet 18, top outlet 20, bottom outlet 22 and return inlet 24. Additionally, separator 16 comprises a bottom portion 26 and an upper portion 28. Conduit 12 is operably connected to feed inlet for conveying the hydrocarbon feed stream to separator 16. Separator 16 defines a separation zone and can be any suitable device which provides means for separating gas and liquid phases. Generally, however, separator 16 is an open vessel that is appropriately sized to permit the gravity settlement of the liquid particles contained within the hydrocarbon feedstream. Additionally, impingement devices can be provided within separator 16 to improve the collection efficiency of liquid particles contained in the hydrocarbon feedstream that enters separator 16.

In separator 16, the hydrocarbon feedstream is separated into first fluid 30 and second fluid 32. First fluid 30, which is primarily in the liquid form but can contain dissolved quantities of gas, settles by gravity to bottom portion 26 of separator 16, and second fluid 32, which is primarily in the form of a gas but can contain entrained quantities of liquid, flows into upper portion 28 of separator 16. In fluid flow communication with bottom portion 26 of separator 16 is thermosyphon heat exchanger 34. Thermosyphon heat exchanger 34 provides means for indirectly exchanging heat from a heat transfer medium to first fluid 30 and can be any suitable type of natural-circulation, vaporizing heat exchanger. Various examples of natural-circulation vaporizing heat exchangers are illustrated and described at length in Kern, *Process Heat Transfer*, pages 471–491 (1st edition, 1950). Examples of such suitable types of natural-circulation heat exchangers for use as thermosyphon heat exchanger 34 can includes bundles which are inserted within separator 16, horizontal thermosyphon heat exchangers, and vertical thermosyphon heat exchangers. Thermosyphon heat exchanger 34 is provided with tube-side inlet 36, tube-side outlet 38, shell-side inlet 40 and shell-side outlet 42. It is preferred that a vertical type thermosyphon heat exchanger be utilized in the present invention with first fluid 30 passing through the tube side of thermosyphon heat exchanger 34.

Thermosyphon heat exchanger 34 is placed in a position relative to separator 16 that provides for sufficient hydrostatic head to permit the natural circulation of first fluid 30 through thermosyphon heat exchanger 34. Fluid flow communication between bottom portion 26 and thermosyphon heat exchanger 34 is provided by conduit 44, which is operably connected between bottom outlet 22 and tube-side inlet 36, for conveying first fluid 30 from separator 16 to thermosyphon heat exchanger 34. Fluid flow communication between upper portion 28 and thermosyphon heat exchanger 34 is provided by conduit 46, which is operably connected between tube-side outlet 38 and return inlet 24, for conveying a vaporized first fluid 30 from thermosyphon heat exchanger 34 to separator 16. As heat is absorbed by first fluid 30 it is vaporized, which creates a density differential and a driving force for permitting natural circulation of the fluid through thermosyphon heat exchanger 34.

The vaporized first fluid 30 passes by way of conduit 46 from thermosyphon heat exchanger 34 to separator 16 wherein the essentially vaporous fluid leaving thermosyphon heat exchanger 34 is commingled with second fluid 32. The commingled fluid then passes through conduit 48 to superheating exchanger 50, which is provided with first inlet 52, second inlet 54, first outlet 56 and second outlet 58, that provides means wherein the commingled fluid is superheated by the indirect transfer of heat energy. Fluid flow communication between separator 16 and superheating exchanger 50 is provided for by conduit 48, which is operably connected between top outlet 20 and first inlet 52. The superheated commingled fluid passes through conduit 60, which is operably connected between first outlet 56 and burner 14, and is fed to burner 14 where it is combusted with air. Optionally, steam can be fed to burner 14 via conduit 62, which is operably connected to burner 14 to provide for fluid flow communication to burner 14, to improve the atomization and combustion of the superheated commingled fluid. The combustion gases pass to the atmosphere via conduit 63, which is operably connected to burner 14, for conveying combustion gases to the atmosphere.

To provide the heat energy for the vaporization of first fluid 30 passing through thermosyphon heat exchanger 34 and to provide the superheat for the superheating of the commingled fluid passing through conduit 48 to superheating exchanger 50, any suitable heat transfer medium can be used. As is illustrated in FIG. 1, closed system 64, used for circulating a heat transfer medium, is provided wherein a first heat transfer fluid is contained and is utilized for transferring heat energy to the process fluids passing through thermosyphon heat exchanger 34 and superheating exchanger 50. Operably located in closed system 64 is vaporizer 66 having first inlet 68, second inlet 70, first outlet 72 and second outlet 74. Vaporizer 66 provides means for evaporating a first heat transfer medium and for indirectly transferring heat energy from a second heat transfer medium to the first heat transfer medium.

Vaporizer 66 can be any suitable type of heat exchange means and is located in closed system 64 in a manner that permits the natural circulation of the first heat transfer fluid though vaporizer 66, thermosyphon heat exchanger 34, and superheating exchanger 50. Providing for fluid flow communication between vaporizer 66 and superheating exchanger 50 are conduits 76 and 78. Operably connected between first outlet 72 and second inlet 54 is conduit 76 for conveying a vaporized first heat transfer fluid from vaporizer 66 and superheating exchanger 50. Operably connected between second outlet 58 and first inlet 68 is conduit 78 for conveying a condensed first heat transfer fluid from superheating exchanger 50 to vaporizer 66. Providing for fluid flow communication between vaporizer 66 and thermosyphon heat exchanger 34 are conduits 80 and 82. Operably connected between conduit 76 and shell-side inlet 40, is conduit 80 for conveying a vaporized first heat transfer fluid from vaporizer 66 to thermosyphon exchanger 34. Conduit 82 is operably connected between thermosyphon exchanger 34 and conduit 78 to provide for conveying a condensed first heat transfer fluid from thermosyphon heat exchanger 34 to vaporizer 66.

Generally, vaporizer 66 will be located in a position relative to thermosyphon heat exchanger 34 and superheating exchanger 50 so that sufficient hydrostatic heat is provided to induce the natural circulation of the first heat transfer fluid through closed system 64. The first heat transfer fluid in a condensed form is passed or circulated via conduits 78 and 82 to vaporizer 66 wherein it is vaporized by the indirect transfer of heat energy from a second heat transfer fluid by means of vaporizer 66. A second heat transfer fluid, such as steam, is fed to vaporizer 66 via conduit 84 that is operably connected to second inlet 70. Conduit 86 is operably connected to second outlet 74 to provide for conveying second heat transfer fluid from vaporizer 66.

A vaporized first heat transfer fluid is utilized as a heat source in superheating exchanger 50 and thermosyphon heat exchanger 34 whereby heat energy is transferred to the process fluid by a condensation mechanism. The vaporized first heat transfer fluid leaves vaporizer 66 and passes through conduits 76 and 80 to superheating exchanger 50 and thermosyphon heat exchanger 34. The vaporized first heat transfer fluid leaving vaporizer 66 is utilized in thermosyphon heat exchanger 34 and superheating exchanger 50 in response to the heat demands created by the process side fluid flow. For example, if the hydrocarbon feedstream passing through conduit 12 has a significant increase in the amount of liquid hydrocarbon contained within said stream, the amount of heat duty required to be supplied by thermosyphon heat exchanger 34 to vaporize first fluid 30 will increase. In general, the amount of heat duty required by thermosyphon heat exchanger 34 will be a function of the flow rate of liquid hydrocarbons entering separator 16. As for the heat duty requirements of superheating exchanger 50, this will be a function of the amount of superheat desired and the mass flow rate of the hydrocarbon feedstream passing through conduit 12. Consequently, there will be a direct functional relationship between the mass flow rate of hydrocarbon feedstream and heat duties required by thermosyphon heat exchanger 34 and superheating exchanger 50. Condensate from thermosyphon heat exchanger 34 and superheating exchanger 50 flows by natural circulation to vaporizer 66 via conduits 78 and 82 to complete the circulation circuit of closed system 64.

To provide the necessary heat energy for vaporizing the liquid hydrocarbon of the hydrocarbon feedstream entering separator 16 and to provide the mount of additional superheat added to the process stream, a second heat transfer fluid is fed to vaporizer 66 via conduit 84. The flow rate of second heat transfer fluid will vary in relationship with the total heat duty demand of thermosyphon heat exchanger 34 and the superheating exchanger 50. To respond to this heat duty demand, second heat transfer fluid is manipulated by control system 88 for controlling the various process variables. In a preferred embodiment of this invention, pressure transducer 90 in conjunction with a pressure sensing device, which is operably located in conduit 76, provides an output signal 92 which is representative of the actual pressure within closed system 64. Output signal 92 is provided as a process variable input to controller 94.

Controller 94 is also provided with set point signal 96 which is representative of the desired pressure within closed system 64. Controller 94 compares output signal 92 and set point signal 96 and provides output signal 98 which is responsive to the difference between output signal 92 and set point signal 96. Output signal 98 is scaled so as to be representative of the flow rate of the second heat transfer fluid required to maintain the actual pressure within closed system 64 substantially equal to the desired pressure within closed system 64 as represented by output signal 92. Output signal 92 is provided as a control signal from controller 94 to control valve 100, which is operably located in conduit means 84.

Control valve 100 is manipulated in response to output signal 98.

As an optional feature of this invention, the second heat transfer fluid flow can be controlled by utilizing a cascade control scheme wherein the set point signal 96 is replaced with output signal 102 from a temperature controller 104. Temperature transducer 106 in conjunction with a temperature sensing device such as a thermocouple, which is operably located in conduit 60, provides output signal 108 that is representative of the actual temperature of the superheated process stream flowing through conduit 60.

Temperature controller 104 is also provided with set point signal 110 which is representative of the desired temperature of the superheated fluid flowing in conduit 60. In response to output signal 108 and set point signal 110, temperature controller 104 provides output signal 102 that is responsive to the difference between output signal 108 and set point signal 110. Output signal 102 is scaled so as to be representative of the actual pressure within closed system 64 required to maintain the actual temperature of the superheated fluid flowing through conduit 60 substantially equal to the desired temperature of the superheated fluid as represented by output signal 108. Output signal 102 can optionally be utilized as a set point signal for controller 94. Controller 94 compares output signal 92 and output signal 102 and establishes output signal 98, which is responsive to the difference between output signal 92 and output signal 102. Output signal 98 is scaled so as to be representative of the flow rate of the second heat transfer fluid flowing through conduit 84 required to maintain the actual pressure within closed system 64 substantially equal to the desired pressure within closed system 64 as represented by output signal 92. Output signal 98 is provided as a control signal from controller 94 to control valve 100. Control valve 100 is manipulated in response to output signal 98.

In summary with respect to the flare gas relief system 10 illustrated in FIG. 1, a hydrocarbon process stream, which can include a mixture of gas and liquid, is fed to separation means or a separation vessel wherein the liquid phase is essentially separated from the gas phase. The liquid phase is vaporized by utilizing a thermosyphon-type heat exchanger with the vapor being mixed with the vapor phase entering separation means. The commingled vapor passes through a heat exchanger where the process fluid is superheated to a desired amount of superheat prior to passing to a flare device where the hydrocarbon is combusted. Heat energy for the thermosyphon exchanger and for the superheating exchanger is provided by a heat transfer fluid that is circulated within a closed system. Any suitable type of heat transfer fluid can be used in the closed system which includes, for example, steam, water, oil, inorganic salts, and commercially available heat transport fluids. Examples of such fluids suitable for heat transport media are illustrated and discussed at length in *Perry's Chemical Engineers' Handbook*, pages 9-74 through 9-81 (6th edition, 1984). The preferred heat transfer fluid for use in the closed system of this invention is methanol.

A first heat transfer fluid is vaporized by a vaporizing exchanger with the resulting vapor passing to a thermosyphon heat exchanger and a superheating exchanger. Heat is transferred through the condensation mechanism whereby the vaporous first heat transfer fluid is condensed. The vaporizing exchanger is suitably located at a position relative to the superheating exchanger and the thermosyphon heat exchanger so as to allow for the accumulation of the necessary hydrostatic liquid heat to promote the natural circulation of the heat transfer fluid through the closed circuit. The heat energy required to provide for the heat of vaporization of the hydrocarbon liquid and the superheat is entered into the system by charging to the vaporizing heat exchanger a second heat transfer fluid medium. Any suitable heat transfer medium can be used for the second heat transfer medium, however, steam is the preferred heat transfer medium. Heat energy from the steam is exchanged by indirect heat transfer, with the condensed first heat transfer medium within the closed system to thereby vaporize the heat transfer medium.

The following table provides calculated ranges and a specific calculated step for the various operating conditions, process flows and compositions in the operation of the herein-described invention.

| Typical Operating Conditions, Flows and Compositions (Calculated) | | |
|---|---|---|
| Hydrocarbon Feedstream 12 | Range | Specific Calculated Example |
| Composition (mol percent): | | |
| Methane | 0-5 | |
| Ethane | 0-5 | |
| Ethylene | 80-100 | 100 |
| Propane | 0-5 | |
| Propylene | 0-5 | |
| Other hydrocarbons | less than one | |
| Liquid Fraction (mol percent) | 0-50 | 29 |
| Flow Rate (pounds per hour) | 250,000-450,000 | 335,440 |
| Temperature (°F.) | −130 to −90 | −105 |
| Pressure (psia) | 14.7 to 50 | about atmospheric |
| Thermosyphon Heat Exchange Means 20 | | |
| Heat Duty (mmbtu per hour) | 0-27 | 24.5 |
| Superheating Exchange Means 26 | | |
| Heat Duty (mmbtu per hour) | 0-35 | 19.1 |
| Closed System 36 | | |
| First Heat Transfer Medium | any suitable fluid | methanol |
| Circulation Rate of First Heat Transfer Medium (pounds per hour) | 0-120,000 | 91,258 |
| Heat Duty of Vaporizing Means 38 | 0-62 | 43.6 |
| Pressure (psia) | 14.7 to 50 | 40.0 |
| Temperature (°F.) | 160-210 | 190 |
| Second Heat Transfer Medium | any suitable fluid | 50 psig sat. steam |
| Flow Rate of Second Heat Transfer Medium (pounds per hour) | 62,000 | 47,253 |

By utilizing the features of the herein-described invention, the flare system of a chemical processing plant can be protected from the passage of extremely cold hydrocarbon process fluids that contain mixtures of gas and liquid. The vaporization of low molecular weight liquid hydrocarbons prior to their entry into a flare system protects the piping and associated equipment from thermal shock and thermal fatigue caused by the rapid, cyclic, and large temperature changes within the system. By preventing the large and rapid changes in temperatures within the system, equipment failure is minimized. Additionally, the vaporization of the liquids and the control of the process fluid temperature within the flare relief system promote better combustion of flare gases. Finally, the preventing of any carryover of liquid hydrocarbon from a combustion flare into the atmosphere provides for a safer working environment.

While the invention has been described in terms of the presently preferred embodiment, reasonable variations and modifications are possible by those skilled in the art. Such variations and modifications are within the scope of the described invention and the appended claims.

That which is claimed is:

1. A method comprising the steps of:

introducing as gas and liquid mixture of hydrocarbon to a separation zone wherein said gas and liquid mixture of hydrocarbon is separated into a first fluid and a second fluid;

transferring said first fluid from said separation zone to thermosyphon heat exchanger means wherein a significant portion of said first fluid is vaporized by the indirect transfer of heat energy from a first heat transfer fluid to form an essentially vaporous fluid;

passing said essentially vaporous fluid to said separating zone wherein it is commingled with said second fluid to form a commingled fluid;

passing said commingled fluid to superheating exchanger means wherein said commingled fluid is superheated by the indirect transfer of heat energy from said first heat transfer fluid to form a superheated fluid; and feeding said superheated fluid to flare means whereby said superheated fluid is combusted.

2. A method in accordance with claim 1 wherein said first heat transfer fluid is contained within a closed system and further comprising the steps of:

passing said heat transfer fluid, which is in the form of a condensed first heat transfer fluid, through vaporizing means to thereby vaporize said condensed first heat transfer fluid by the indirect transfer of heat energy from a second heat transfer fluid thereby forming a vaporized first heat transfer fluid;

utilizing said vaporized first heat transfer fluid in said thermosyphon heat exchanger means and said superheating exchanger means wherein heat energy is transferred by the condensation of said vaporized first heat transfer fluid thereby forming said condensed first heat transfer fluid; and returning said condensed first heat transfer fluid to said vaporizing means.

3. A method in accordance with claim 2, further comprising the steps of:

supplying said second heat transfer fluid to said vaporizing means; and manipulating the flow rate of said second heat transfer fluid in response to the heat duty demands of said thermosyphon heat exchanger means and of said superheating exchanger means wherein said step of manipulating the flow rate of said second heat transfer fluid comprises:

establishing a first signal representative of the actual pressure within said closed system;

establishing a second signal representative of the desired pressure within the closed system;

comparing said first signal and said second signal and establishing a third signal which is responsive to the difference between said first signal and said second signal, wherein said third signal is scaled so as to be representative of the flow rate of said second heat transfer fluid required to maintain the actual pressure within said closed system substantially equal to the desired pressure within said closed system represented by the second signal; and manipulating the flow rate of said second heat transfer fluid in response to said third signal.

4. A method in accordance with claim 3, further comprising the steps of:

establishing a fourth signal representative of the actual temperature of said superheated fluid;

establishing a fifth signal representative of the desired temperature of said superheated signal;

comparing said fourth signal and said fifth signal and establishing a sixth signal which is responsive to the difference between said fourth signal and said fifth signal, wherein said sixth signal is scaled sos as to be representative of the actual pressure within said closed system required to maintain the actual temperature of said superheated fluid substantially equal to the desired temperature of said superheated fluid represented by said fifth signal;

utilizing said sixth signal as said second signal; and manipulating the flow rate of said second heat transfer fluid in response to said third signal.

5. Apparatus for processing a hydrocarbon feedstream comprising a hydrocarbon gas and a hydrocarbon liquid, comprising:

phase separator means, having a feed inlet, a top outlet, a bottom outlet and a return inlet, for separating said hydrocarbon feedstream into a first fluid comprising essentially hydrocarbon liquid and a second fluid comprising essentially hydrocarbon gas;

first conduit means operably connected to said feed inlet for conveying said hydrocarbon feedstream to said phase separator means;

thermosyphon heat exchanger means, having a tube-side inlet, a tube-side outlet, shell-side inlet and shell-side outlet for vaporizing said first fluid by the indirect transfer of heat energy from a first heat transfer medium to said first fluid to produce a vaporized first fluid;

second conduit means, operably connected between said bottom outlet and said tube-side inlet, for conveying said first fluid to said thermosyphon heat exchanger means;

third conduit means, operably connected between said tube-side outlet and said return inlet, for conveying said vaporized first fluid to said phase separator means wherein said vaporized first fluid is commingled with said second fluid to form a commingled fluid;

superheating exchanger means, having a first inlet, a first outlet, a second inlet and a second outlet, for superheating said commingled fluid by the indirect transfer of heat energy said first heat transfer medium to said commingled fluid to produce a superheated fluid;

fourth conduit means operably connected between said top outlet and said first inlet for conveying said commingled fluid to said superheating exchanger means;

burner means for mixing said commingled fluid with an oxygen-containing gas and for combusting the thus-formed mixture;

fifth conduit means, operably connected between said first outlet and said burner means, for conveying said superheated fluid from said superheating exchanger means to said burner means;

vaporizer means, having a vaporizer first inlet, a vaporizer first outlet, a vaporizer second inlet and a vaporizer second outlet, for evaporating said first heat transfer medium by the indirect heat transfer of heat energy from a second heat transfer medium to said first heat transfer medium to produce a vaporized first heat transfer medium;

sixth conduit means operably connected between said vaporizer first outlet and said second inlet for conveying said vaporized first heat transfer medium from said vaporizer means to said superheating exchanger means;

seventh conduit means operably connected between said second outlet and said vaporizer first inlet for conveying a condensed first heat transfer medium from said superheating exchanger means to said vaporizer means;

eighth conduit means operably connected between said sixth conduit means and said shell-like inlet for conveying said vaporized first heat transfer medium from said sixth conduit means to said thermosyphon heat exchanger means;

ninth conduit means operably connected between said shell-side outlet and said seventh conduit means for conveying said condensed first heat transfer medium from said thermosyphon heat exchanger means to said seventh conduit means;

tenth conduit means, operably connected to said vaporizer second inlet, for conveying a second heat transfer medium to said vaporizer means; and eleventh conduit means, operably connected to said vaporizer second outlet, for conveying said second heat transfer medium from said vaporizer means.

6. Apparatus in accordance with claim 5, further comprising:

means for establishing a first signal representative of the actual pressure within said sixth conduit means;

means for establishing a second signal representative of the desired pressure within said sixth conduit means;

means for comparing said first signal and said second signal and establishing a third signal which is responsive to the difference between said first signal and said second signal; wherein said third signal is scaled so as to be representative of the flow rate of said second heat transfer medium required to maintain the actual pressure within said sixth conduit means substantially equal to the desired pressure within said sixth conduit means as represented by said second signal; and control valve means, interposed in said tenth conduit means, for manipulating the flow rate of said second heat transfer medium in response to said third signal.

7. Apparatus in accordance with claim 6, further comprising:

means for establishing a fourth signal representative of the actual temperature of said superheated fluid;

means for establishing a fifth signal representative of the desired temperature of said superheated fluid;

means for comparing said fourth signal and said fifth signal and establishing a sixth signal which is responsive to the difference between said fourth signal and said fifth signal, wherein said sixth signal is scaled so as to be representative of the actual pressure within said sixth conduit means required to maintain the actual temperature of said superheated fluid substantially equal to the desired temperature of said superheated fluid as represented by said fifth signal; and means for utilizing said sixth signal as second signal.

8. An apparatus in accordance with claim 7, further comprising:

twelfth conduit means operably connected to said burner means for conveying steam to said burner means.

9. A method for processing a hydrocarbon feedstream comprising a hydrocarbon gas and a hydrocarbon liquid, comprising:

separating said hydrocarbon feedstream into a first fluid comprising essentially hydrocarbon liquid and a second fluid comprising essentially hydrocarbon gas;

vaporizing said first fluid by the indirect transfer of heat energy from a vaporized first heat transfer medium, which is contained within a closed system, to said first fluid to produce a vaporized first fluid and a condensed first heat transfer medium;

commingling said vaporized first fluid with said second fluid to form a commingled fluid;

superheating said commingled fluid by the indirect transfer of heat energy from said vaporized first heat transfer medium to said commingled fluid to produce a superheated fluid and said condensed first heat transfer medium;

mixing said commingled fluid with an oxygen-containing gas to form a combustion mixture;

combusting said combustion mixture; and evaporating said condensed first heat transfer medium by the indirect heat transfer of heat energy from a second heat transfer medium to said condensed first heat transfer medium to produce said vaporized first heat transfer medium.

10. A method in accordance with claim 9, further comprising:

establishing a first signal representative of the actual pressure within said closed system;

establishing a second signal representative of the desired pressure within said closed system;

comparing said first signal and said second signal and establishing a third signal which is responsive to the difference between said first signal and said second signal, wherein said third signal is scaled so as to be representative of the flow rate of said second heat transfer medium required to maintain the actual pressure within said closed system substantially equal to the desired pressure within said closed system represented by said second signal; and manipulating the flow rate of said second heat transfer medium in response to said third signal.

11. A method in accordance with claim 10, further comprising:

establishing a fourth signal representative of the actual temperature of said superheated fluid;

establishing a fifth signal representative of the desired temperature of said superheated fluid;

comparing said fourth signal and said fifth signal and establishing a sixth signal which is responsive to the difference between said fourth signal and said fifth signal, wherein said sixth signal is scaled so as to be representative of the actual pressure within said closed system required to maintain the actual temperature of said superheated fluid substantially equal to the desired temperature of said superheated fluid as represented by said fifth signal; and utilizing said sixth signal as said second signal.

* * * * *

UNITED STATES PATENT AND TRADEMARK OFFICE

CERTIFICATE OF CORRECTION

PATENT NO. : 5,135,386

DATED : August 4, 1992

INVENTOR(S) : Mark K. Kelley and Max W. Thompson

It is certified that error appears in the above-identified patent and that said Letters Patent is hereby corrected as shown below:

Column 9, line 16, after "introducing", please delete "as" and insert therefor ---a---.

Column 9, line 25, please delete "separating" and insert therefor ---separation---.

Column 11, line 26, please delete "shell-like" and insert therefor ---shell-side---.

Signed and Sealed this

Tenth Day of August, 1993

*Attest:*

*Attesting Officer*

Michael K. Kirk

MICHAEL K. KIRK

*Acting Commissioner of Patents and Trademarks*